United States Patent [19]

Geczy

[11] 4,276,944

[45] Jul. 7, 1981

[54] IN-HOLE MOTOR WITH BIT CLUTCH

[75] Inventor: Bela Geczy, Glendale, Calif.

[73] Assignee: Smith International, Inc., Newport Beach, Calif.

[21] Appl. No.: 67,756

[22] Filed: Aug. 20, 1979

[51] Int. Cl.[3] ..... E21B 4/02

[52] U.S. Cl. ..... 175/102; 175/107

[58] Field of Search ..... 175/101, 107; 192/91 A, 192/67 P

[56] References Cited

U.S. PATENT DOCUMENTS 2,167,019 7/1939 Yost ..... 175/107

FOREIGN PATENT DOCUMENTS 291027 12/1971 U.S.S.R. ..... 192/91 A 395557 12/1971 U.S.S.R. ..... 175/101

*Primary Examiner*—William F. Pate, III

*Attorney, Agent, or Firm*—Philip Subkow; Bernard Kriegel

[57] ABSTRACT

An in-hole fluid motor assembly has a clutch engageable between the bearing housing and the drive shaft which is rotatable in the bearing housing, to connect the housing to the shaft and enable rotation of the bit by the housing. The clutch is engaged without increasing the load imposed on the bit. Drilling fluid in or flowing through the assembly and into the drive shaft is employed to hold the clutch disengaged while the circulating pump is running, and a spring normally acts to engage the clutch when the circulation of fluid is diminished by stopping the pump. In one form, the clutch may be automatically engaged if circulation is blocked and the pump continues to apply pressure to the fluid.

9 Claims, 6 Drawing Figures

IN-HOLE MOTOR WITH BIT CLUTCH

THE PRIOR ART

The prior art is Russian Pat. No. 395,557 granted Nov. 22, 1973, in the application of Trzeciak, Ser. No. 957,179, filed Nov. 2, 1978 and owned by the assignee of the present application.

In the Russian structure a spindle is rotatable in a drill pipe string and has a bit at its lower end. A fluid motor seats in the pipe and has its drive shaft engaged in the spindle to drive the bit. When the drill string is picked up, the motor is disengaged from the spindle and a clutch is engaged between the drill string and the spindle.

In the Trzeciak structure a bit sub has a torque transmitting connection with the drive shaft of an in-hole motor and thrust is transferred from the motor to the bit sub through a member which allows engagement of a clutch between the motor stator and the bit sub, when sufficient thrust load is applied downwardly on the bit. Thereafter, the bit can be rotated and pulled upon by the pipe string containing the motor.

BACKGROUND OF THE INVENTION

In my companion application, Ser. No. 055,373 filed July 6, 1979, there is disclosed an in-hole fluid motor drilling apparatus, wherein the rotor of the motor is connected to one end of the shaft which is supported in the bearing housing and has a bit at its other end. Drilling weight is transferred from the housing to the shaft, and thence to the bit during drilling operations. A clutch is provided between the housing and the shaft which can be engaged without increasing the load on the bit. While such clutches can be engaged by relative motion of the housing and the shaft, without increasing the load on the bit, as disclosed in my companion applications Ser. Nos. 067,882 filed Aug. 20, 1979 and 068,147, filed Aug. 20, 1979, by longitudinal upward movement of the housing with respect to the stuck bit, or by rotation of the housing relative to the stuck bit, the clutches in my pending application, Ser. No. 55,373, are disengaged by fluid pressure and engaged by a spring when the circulation of drilling and motor fluid is reduced. Specifically, the clutches of the above-identified application (Ser. No. 55,373) are disengaged by the differential pressure caused by the flow of fluid through a restriction in the bearing assembly, which is of the mud lubricated type.

Sealed bearings are also known for use with in-hole fluid driven motors. One example of a sealed bearing assembly is that illustrated in Tschirky et al, U.S. Pat. No. 4,098,561, granted July 4, 1978. Another sealed bearing assembly for in-hole motors is disclosed in the pending application filed by me and John E. Tschirky on July 25, 1977, Ser. No. 818,423.

In the case of in-hole motor drill assemblies of the fluid driven types, wherein the rotary drill bit is driven by the in-hole motor disposed between the running pipe string and the bit, it is not, as a rule, possible to cause the bit to rotate by rotation of the running or drill pipe string above the motor. The reaction torque of such in-hole motors is, generally, taken by a rotary table at the surface of the bore hole, whereby the drill pipe string can either be held stationery, or if desired, rotated, while the motor is driving the bit, to obviate the wedging of the pipe string. However, if the bit becomes stuck in the bore hole, such in-hole motors will stall and the rotation of the bit may not be possible, notwithstanding the availability of additional drilling fluid pressure. When such motor drills are stalled in the bore hole rotation of the drill pipe string by the rotary table, is ineffective to cause bit rotation, since there is no positive drive between the stator and the rotor, and the bit remains wedged or stuck in the hole. The bit clutch of Trzeciak provides a structure enabling rotation of the bit by rotation of the drill string without interfering with normal operation of the drilling apparatus.

SUMMARY OF THE INVENTION

The present invention relates to a clutch device which can be engaged to enable rotation of the motor shaft and bit by rotation of the housing, without applying additional downward thrust on the bit. If the bit is stuck in soft formation, for example, the application of additional weight to the bit may interfere with efforts to release the bit, because the bit is forced deeper into the formation in which it is stuck.

It is a feature of the invention that the clutch is incorporated in normal in-hole drilling motor apparatus, so that the normal drilling operations can be performed, the clutch being selectively engageable, when desired, enabling bit rotation by rotation of the pipe string, while a pull is applied to the bit. When the bit is freed, circulation of fluid through the motor can drive the bit as it is moved upwardly.

The clutch forms illustrated in the present application are hydraulically operated by drilling fluid flowing through the motor shaft and exiting through the bit. In one form, so long as the circulating pump for the drilling fluid is running, causing a pressure in the shaft in excess of the pressure externally of the assembly, the clutch remains disengaged. Upon cessation of the pumping of drilling fluid, the clutch is automatically engaged by a spring force. In another form, the clutch is disengaged by the flow of fluid through the assembly.

The clutches of the present invention can be employed with bearing assemblies of the mud lubricated type or, since the clutches hereof are operated by fluid flowing through the shaft, so that fluid flow through the bearings is not necessary to operate the clutches, the bearing housing can be sealed.

Preferably, the clutches of the present application are used in combination with a circulation valve, according to my companion application now Ser. No. 055,690, filed July 6, 1979. This permits engagement of the clutches while circulation through the annulus continues.

This invention possesses many other advantages, and has other objects which may be made more clearly apparent from a consideration of several forms in which it may be embodied. Such forms are shown in the drawings accompanying and forming part of the present specification. These forms will now be described in detail for the purpose of illustrating the general principles of the invention; but it is to be understood that such detailed description is not to be taken in a limiting sense.

DESCRIPTION OF THE PREFERRED EMBODIMENTS

Figure 1:
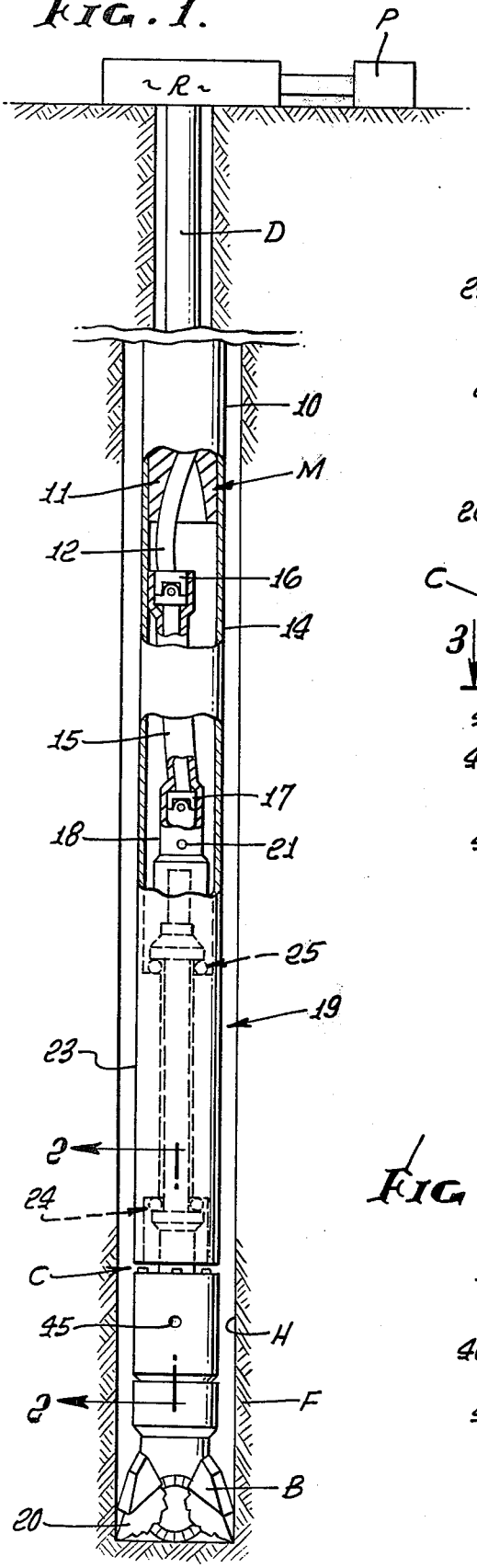
FIG. 1 is a view diagramatically showing an in-hole motor drill, partly in elevation and partly in section, in an earth bore hole, and incorporating a clutch structure in accordance with the invention.

As seen in the drawings, referring first to FIG. 1, an in-hole motor assembly M is connected to the lower end of a string of drilling fluid conducting drill pipe D and has its housing 10 providing a progressive cavity stator 11 for a rotatable helicoidal rotor 12. The illustrative motor is a positive displacement type fluid motor of a well known kind. The rotor is driven by the downward flow of drilling fluid supplied to the drill string from the usual pump P provided on a drilling rig having a rotary R which can rotate the pipe string D while it is suspended by the usual drilling lines of the derrick or rig (not shown). The fluid passes downwardly through a connecting rod housing section 14 which contains a connecting rod assembly 15, connected by a universal joint 16 to the lower end of the rotor 12 and by a universal joint 17 to the upper end of the drive shaft 18. The drive shaft extends downwardly through a bearing assembly 19, and at its lower end, the drive shaft is connected to a drill bit B, having cutters 20 adapted to drill through the earth formation F, in the drilling of a bore hole H. The drive shaft 18 is tubular and has adjacent its upper end inlet ports 21, through which the drilling fluid passes from the connecting rod housing 14 into the elongated central bore 22 of the drive shaft, the fluid exiting from the bit B to flush cuttings from the bore hole to cool the bit.

During operation of the fluid motor M, the lower end of the rotor 12 has an eccentric motion which is transmitted to the drive shaft 18 by the universal connecting rod assembly 15, and the drive shaft 18 revolves about a fixed axis within the outer housing structure 23 of the bearing assembly 19, the drive shaft being supported within the housing by bearing means 24 and 25 as shown in broken lines in FIG. 1. Such bearing assemblies are well known and take various forms. As previously indicated lubricated bearing assemblies which are sealed against the deleterious effects of the drilling fluid are disclosed in the above-identified U.S. Pat. No. 4,098,561 and in the above-identified pending application Ser. No. 818,423. Bearing assemblies of the mud lubricated type, wherein a certain quantity of the drilling fluid is allowed to by-pass through the bearings to cool and lubricate them are also known, and as example is illustrated in U.S. Pat. No. 4,029,368 granted to Tschirky et al for Radial Bearings.

In the illustrative assembly, the lower bearing 24 is a set down bearing, in the sense that the weight of the drill string is applied to the drill bit through the bearing assembly 24. On the other hand, the upper bearing 25 is characterized as a pick-up bearing, in that the housing can transmit an upward thrust to the drive shaft 18 when the housing is elevated by the drill pipe string to remove the motor drill assembly from the well bore. In the event that the bit is stuck in the well bore, and it is desired to rotate the bit by rotation of the running pipe string, the present invention provides clutch means C which are automatically engaged without applying additional weight on the bit, by simply ceasing the circulation of drilling fluid through the drill pipe string and through the shaft 18, by shutting down pump P.

Figure 2:
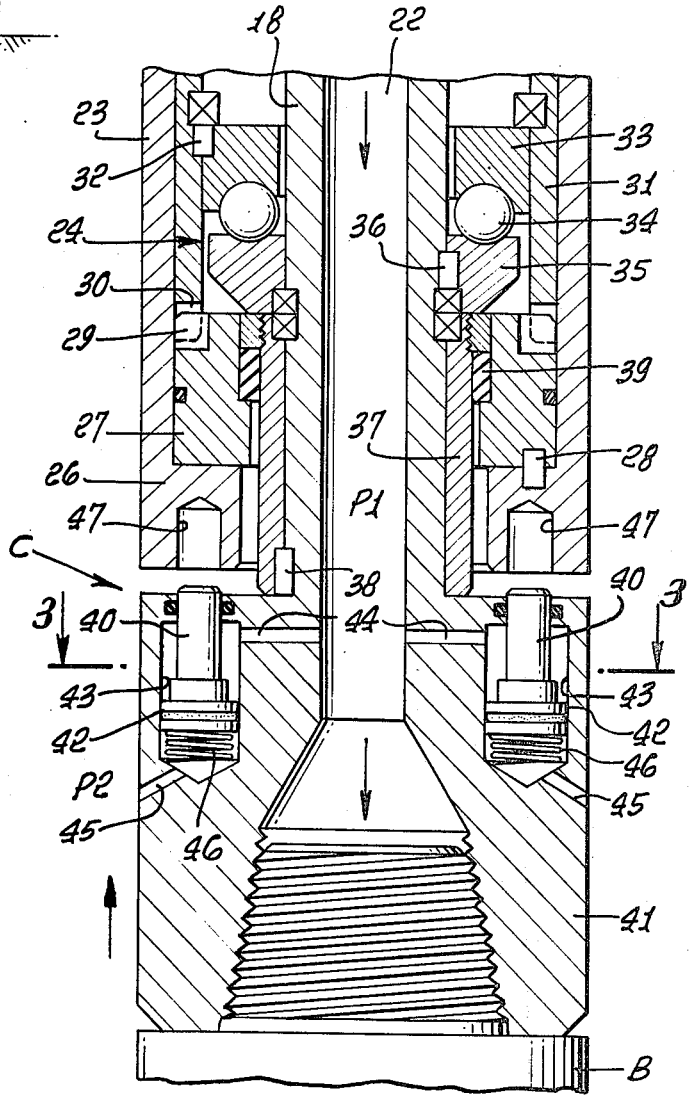
FIG. 2 is an enlarged, fragmentary, longitudinal section, as taken on the line 2—2 of FIG. 1, showing one embodiment of the clutch disengaged.

Referring to the embodiment shown in FIG. 2, the bearing housing 23 terminates at its lower end in a circumferentially extended internal flange section 26, on which rests a sleeve or ring 27 pinned to the flange 26, as by one or more pins 28, for rotation together. The ring 27 has a number of circumferentially spaced lugs 29 adjacent its upper end engaged with companion downwardly extending lugs 30 provided on a drive sleeve 31 which is pinned at 32 to an upper bearing race 33. The upper bearing race engages bearing balls 34 which, in turn, are engaged with a lower bearing race 35 which is keyed to the shaft 18 as by a suitable number of pins or keys 36. An internal sleeve 37 is pinned as at 38 for rotation with the shaft. Inasmuch as, as will be later described, the clutch means C is operable in response to differential pressure in the fluid passageway 22 and in the annular space outside of the assembly, in the bore hole H, the illustrative bearing assembly is shown as having suitable packing 39 between the outer drive ring 27 and the inner sleeve 37, forming a seal which isolates the interior of the bearing assembly from the drilling fluid in the annulus outside of the assembly. In the event that the bearing assembly is mud lubricated, there would be no such packing 39 installed, but, instead, drilling fluid would be allowed to flow, at a restricted rate, through a gap between the outer drive member 27 and the inner sleeve 37, as will be well recognized.

Figure 3:
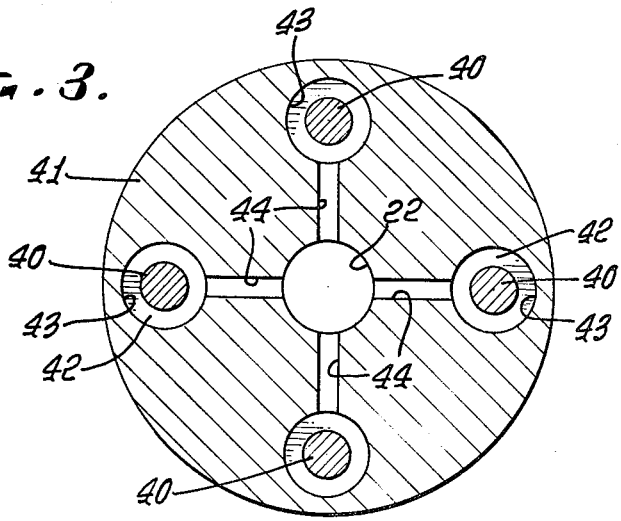
FIG. 3 is a transverse section taken on the line 3—3 of FIG. 2.
Figure 4:
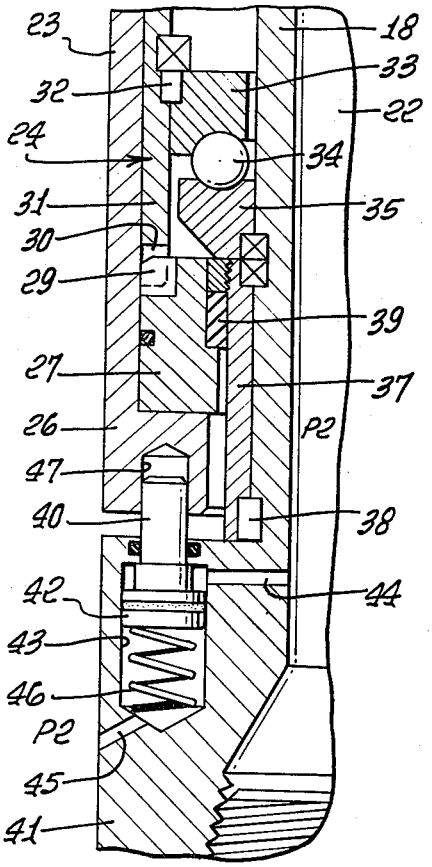
FIG. 4 is a fragmentary section showing the clutch of FIG. 2 in the engaged condition.

In the form illustrated in FIGS. 2 through 4, the clutch means C comprises a suitable plurality, as seen in FIGS. 2 and 3, of clutch elements 40 carried by the enlarged lower bit connector end 41 of the drive shaft 22 and actuatable into engagement with the lower end of the housing flange 26. In the specific form illustrated, the clutch elements 40 are constituted by rods which are provided on pistons 42, reciprocable in piston chambers 43, provided in circumferentially spaced relation, in the enlarged lower end 41 of the drive shaft 18. Radial ports 44 establish communication between the central bore 22 of the drive shaft and the respective piston chambers 42. Other ports 45 are provided for communication between the annular space outside of the shaft section 41 and the piston chambers 43. The ports 44 communicate with the piston chambers 43 above the pistons 42, while the ports 45 communicate with the piston chambers below the pistons 42. The piston rods 40 sealingly project through the upper wall of the piston chambers 43 into a space which communicates with the annulus outside of the assembly. Accordingly, in the absence of fluid flow through the bore 22 of the shaft and through passageways in the bit to cause a differential pressure, the clutch elements 40, including the pistons 42 are exposed to substantially equalized hydrostatic pressure.

Springs 46 are provided beneath the pistons 42 to normally bias the pistons upwardly for causing the rods or clutch elements 42 to engage in companion recesses 47 provided in the lower flange 26 of the housing, as illustrated in FIG. 4. While the illustrated structure is a simple one, utilizing the pistons rods 40 as clutch elements, it will be understood, that if desired, an intermediate clutch drive ring may be employed as disclosed in my companion application Ser. No. 55,373 or other specific torque transmitting means may be employed.

Figure 5:
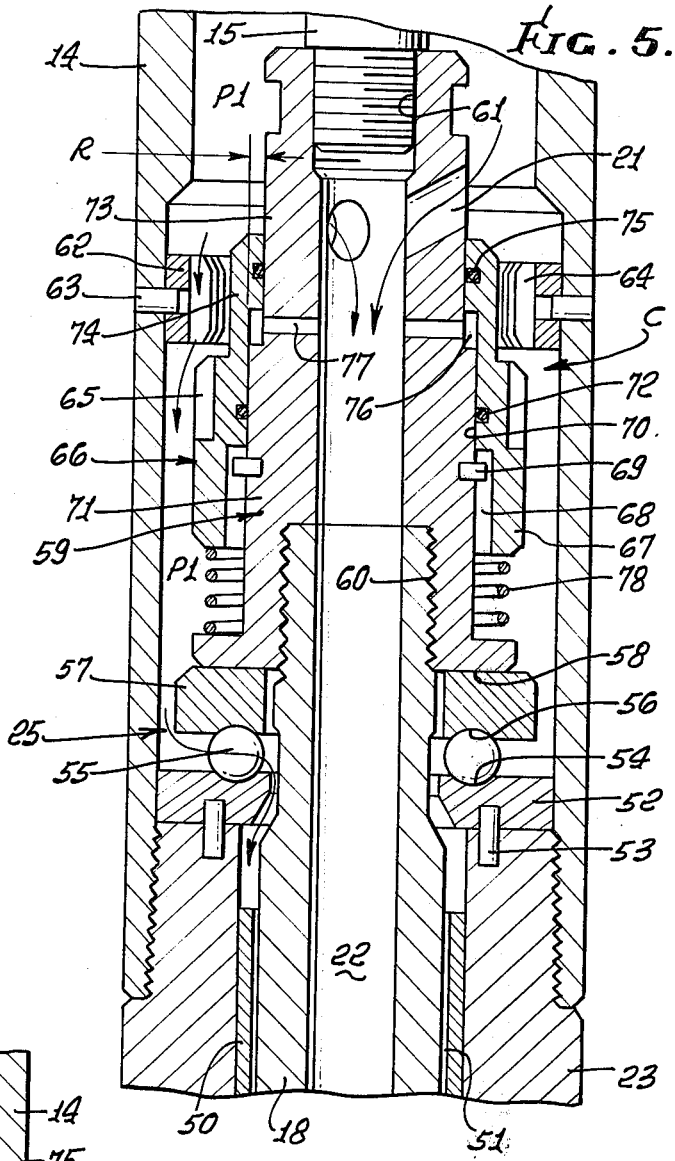
FIG. 5 is a fragmentary longitudinal section showing another embodiment of the clutch disengaged.
Figure 6:
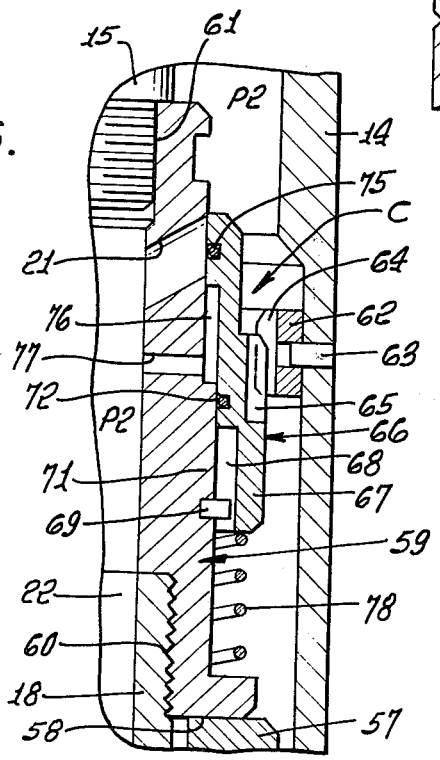
FIG. 6 is a fragmentary section showing the clutch of FIG. 5 in the engaged condition.

Referring to FIGS. 5 and 6, a modified fluid disengaged and spring engaged clutch construction C is illustrated, wherein the clutch is responsive to the pressure or flow of drilling fluid through the assembly. The illustrated bearing assembly is of a simple form, adapted to be lubricated and cooled by the flow of a certain amount of drilling fluid downwardly through the bearing housing, the drilling fluid flow between the shaft 18 and the housing 23 being restricted by a flow restricting sleeve 50 mounted between the bearing housing and the shaft and providing restricted fluid passageway 51, whereby the majority of drilling fluid is caused to flow downwardly through the central bore 22 of the drive shaft 18. Such flow restrictors are well known, and may be made in accordance with the above-identified U.S. Pat. No. 4,029,368.

The pick-up bearing assembly 25, as seen in FIG. 5, includes a lower bearing race 52 connected to the housing 23, for rotation therewith, as by pins 53, and providing a lower raceway 54 engaged by bearing balls 55 which are also engaged in an upper raceway 56 provided in an upper bearing race 57. The bearing assembly 25 is disposed between the lower end shoulder 58 of a connector cap 59 which has a threaded connection 60 with the upper end of the shaft and which provides the above described inlet ports 21, whereby as shown by the arrows in FIG. 5, fluid can flow into the shaft 22 from the connecting rod housing 14. The cap 59 also provides a threaded connection 61 with the lower end of the universal connecting rod 15.

The clutch C includes, in this form, a torque transmitting clutch ring 62 fixed in the housing structure, as by suitable pins or keys 63, for rotation with the housing. Internally, the clutch ring 62 has a suitable number of circumferentially spaced splines or clutch teeth 64 engageable by companion splines or clutch teeth 65 on a clutch ring or sleeve 66 which is mounted on a shaft, or more particularly, as shown, on the connector cap 59 for, longitudinal sliding movement and for rotation with the shaft. To connect the clutch rings 66 to the shaft, suitable means may be employed, such as a downwardly extended skirt 67 on the clutch ring 66 having one or more circumferentially spaced and longitudinally extended slots 68 which receive a pin or key 69 enabling longitudinal movement of the clutch ring 66, but connecting the clutch ring 66 to the shaft for unitary rotation.

The clutch ring 66 includes a lower section having a bore 70 slidably disposed upon a cylindrical section 71 of the connector cap, with a suitable side ring seal 72, slideably and sealingly engaged therebetween. Above the cylindrical cap section 71 is a reduced diameter cylindrical section 73 with which an upwardly extended section 74 of the clutch ring is slideably and sealingly engaged by means of a side ring seal 75. A chamber 76 is formed between the upper and lower sections of the clutch ring 66, between the lower seal 72 and the upper seal 75, this chamber being in communication with the passage 22 through the shaft, as by means of a suitable number of circumferentially spaced radial ports 77. It should be noted at this point that the clutch ring or sleeve 66 has an annular area R which corresponds with the annular area of the sleeve 66 providing the upper wall of the chamber 76, whereby, in a manner to be later described, the clutch sleeve 66 is, under drilling conditions, urged downwardly to the position of FIG. 5, against the upward bias of a spring 78, shown as a coiled spring disposed between the lower end of the clutch sleeve 66 and an upwardly facing shoulder provided on the lower end of the cap.

Referring to FIG. 5, the structure is shown in a condition, wherein, as indicated by the arrows, drilling fluid is being circulated downwardly through the running pipe string, entering the drive shaft passage 22 through the ports 21. Under these circumstances, there is a net downward force applied to the sleeve 66 which can overcome the upward bias of the spring 78. This net downward force is derived from the velocity or kinetic energy of the fluid flowing downwardly through the connecting rod housing, into the ports 21 and downwardly about the exterior of the clutch sleeve 66 acting across the upper end of the clutch sleeve 66. In addition, as the fluid enters the ports 21 from the relatively large flow area of housing 14 and flows downwardly through the relatively small flow area of the shaft passage 22, the fluid pressure within the shaft passage 22 at the ports 77 and in chamber 76 is reduced, so that there is a pressure differential acting across the annular area R which causes a downward force to be applied to the piston.

So long as the flow of drilling fluid downwardly through the running pipe string, through the ports 21, and through the shaft passage 22 continues at a rate causing sufficient kinetic fluid force and differential pressure, in the housing and in the shaft, to overcome the spring 78, the clutch will remain disengaged. The upper end of the clutch sleeve 66 cannot cover the ports 21 during the flow of fluid through the ports, due to the impingement force applied by the fluid against the upper end of the clutch sleeve.

However, when such fluid flow is diminished, so that the pressure difference, including the dynamic difference, does not overcome the upward bias of the spring 78, the clutch ring 66 will be moved upwardly, to the position shown at FIG. 6, wherein it is indicated that pressure P2 exists both in the shaft and in the housing above the ports 21, so that the clutch ring is essentially pressure balanced, and the spring 78 can bias the clutch ring 66 upwardly, to bring the companion clutch teeth 64 and 65 into coengagement, thereby enabling rotation of the shaft, and therefore a drill bit, in response to rotation of the running drill pipe.

It will be understood that the reduction in fluid flow through the shaft, to cause the clutch to engage, can be accomplished by shutting down the circulating pump, at the top of the well bore or by opening the circulation valve V.

SUMMARY OF OPERATION

In normal operation when drilling with an in-hole motor, weight is applied to the bit through the drill string and through the motor shaft bearing 24. Drilling fluid or mud is circulated through the motor, the shaft and the bit and returns to the top of the hole through the annulus. The bit has orifices which restrict fluid flow so that the fluid pressure in the shaft exceeds the pressure in the annulus, usually by a number of hundreds of pounds per square inch, say 200–300 psi. When circulation is stopped, by shutting down the pump, the pressures in the shaft and in the annulus are equalized at a hydrostatic pressure depending upon the weight of the drilling fluid.

Clutch motor pistons 42 and clutch sleeve 66 have equal areas exposed to hydrostatic pressure. When the pump is idle or when the circulation valve is open, the clutch springs cause clutch engagement.

In the case of a turbine or an electric motor, even when stalled, further fluid flow may be substantial, until the pump is shut down. In the case of a positive displacement motor, as shown, when the bit is stalled, flow through the motor will be reduced, or blocked.

In the event of a cave-in which blocks the flow of fluid upwardly in the annulus, high pressure is maintained in the shaft in positive displacement, as well as turbine or electric motors, until the pump is shut down, but there is no substantial flow through the shaft.

With these conditions in mind, the clutches of this application operate as follows:

FIGS. 2-4:

During normal drilling, pressure in the shaft passage 22 exceeds the pressure in the annulus by the drop through the bit. This differential pressure acts in chambers 43 to overcome the motor springs 46, disengaging the clutch.

If the bit stalls stopping flow through the motor, or if circulation valve V is opened, pressure in the drive shaft passage 22 is reduced or interrupted by stopping the circulation pump. The pressure in the drill string is equalized with hydrostatic pressure in the annulus, and motor pistons 42 are biased by springs 46 to engage the clutch.

If the bore hole wall caves in, blocking flow or circulation through the annulus, but the motor is not stalled, pressure in the drive shaft passage 22 will increase, holding the motor pistons against engagement of the clutch until the pump is shut down. The pressure at 44 is the hydrostatic pressure in 22 which is equal to the hydrostatic pressure in the annulus. Equalization of pressure in the drive shaft passage and in the annulus occurs, and springs 46 engage the clutch.

With the clutch engaged, torque can be transmitted to the bit from the motor housing structure by rotation of the drill pipe string.

If the bit is freed, fluid can be circulated through the motor to drive the bit as it is elevated through the bore hole.

FIGS. 5 and 6:

During normal drilling, the flow of fluid into shaft ports 21 and downwardly past the clutch sleeve 66 causes a reduced pressure in chamber 76, due to the higher velocity of fluid flow through shaft passage 22 at the ports 77, as compared with the flow rate of the fluid in the housing, and through the flow restrictor 51 into the annulus. The resultant pressure acting on the area R creates a force which is greater than the result of the pressure at 77 acting on the same area R in chamber 76. Velocity pressure also acts on the sleeve 66, compressing spring 78 to hold the clutch disengaged.

If the bit stalls, or if circulation valve V is opened, flow through the shaft and past the clutch sleeve is reduced, equalizing pressures on the sleeve 66, acting at the area R and at the chamber 76 and spring 78 causes the clutch to engage.

If the bore hole wall caves in, blocking flow or circulation through the annulus or bore 22, causing no flow through the bearing assembly, hydrostatic pressure is equalized on sleeve 66, and spring 78 engages the clutch.

With the clutch engaged, torque can be transmitted to the bit from the motor housing structure by rotation of the drill pipe string.

If the bit is freed, fluid can be circulated through the motor to drive the bit as it is elevated through the bore hole.

I claim:

1. An in-hole motor adapted for connection with a rotatable pipe string and a bit, said assembly comprising: a motor stator including a housing structure adapted to be installed in a pipe string; a rotor in said stator; a drive shaft in said housing connected at one end of said shaft with said rotor for rotation therewith and extending from said housing at the other end of said shaft to drive a drill bit; a fluid opening in said shaft having an inlet at said one end of said shaft to conduct fluid from said stator to said other end, a fluid discharge opening at said other end of said shaft and a fluid discharge opening from said housing to the exterior of said housing; a clutch member mounted on said shaft and an other clutch member mounted on said housing springs biasing one of said members towards the other of said members to engage said clutch to couple said housing to said shaft for joint rotation; and fluid operated means to disengage said clutch when fluid pressure in said shaft is in excess of the pressure outside the housing.

2. An in-hole motor assembly as defined in claim 1; said shaft having an enlarged bit connector at said other end, said clutch including torque transmitting members shiftably carried by said bit connector and engageable with said housing.

3. An in-hole motor assembly as defined in claim 1; said shaft having an enlarged bit connector at said other end, said clutch including torque transmitting members shiftably carried by said bit connector and engageable with said housing, said means to disengage said clutch including piston and cylinder means in said bit connector, a fluid port leading from said shaft opening to said piston and cylinder means to disengage said torque transmitting members from said housing.

4. An in-hole motor assembly as defined in claim 1; said shaft having an enlarged bit connector at said other end, said clutch including torque transmitting members shiftably carried by said bit connection and engageable with said housing, said means to disengage said clutch including piston and cylinder means in said bit connection, a fluid port leading from said shaft opening to said piston and cylinder means to disengage said torque transmitting members from said housing, and a spring biasing said torque transmitting members to engage said housing upon reduction in pressure in said shaft opening.

5. An in-hole motor assembly as defined in claim 1; means sealing said assembly between said shaft and said housing.

6. An in-hole motor as defined in claim 1; said clutch including a torque transmitting member fixed in said housing adjacent to said inlet in said shaft, a torque transmitting member mounted on said shaft for mutual rotation and longitudinal movement to engage said torque transmitting member in said housing, said torque transmitting member on said shaft having an area responsive to the pressure of fluid entering said inlet to disengage said torque transmitting members.

7. An in-hole motor as defined in claim 1; said clutch including a torque transmitting member fixed in said housing adjacent to said inlet in said shaft, a torque transmitting member mounted on said shaft for mutual rotation and longitudinal movement to engage said torque transmitting member in said housing, said torque transmitting member on said shaft having an area responsive to the pressure of fluid entering said inlet to disengage said torque transmitting members, and a spring engaged with the torque transmitting member on said shaft to engage said torque transmitting members when flow of fluid through said inlet is reduced.

8. An in-hole motor as defined in claim 1; said clutch including a torque transmitting member fixed in said housing adjacent to said inlet in said shaft, a torque transmitting sleeve mounted on said shaft for mutual rotation and longitudinal movement to engage said torque transmitting member in said housing, said shaft and said sleeve having axially spaced different diameters forming a pressure chamber, and a port between said shaft opening and said chamber, whereby pressure of fluid ahead of said shaft inlet exceeds the pressure of fluid in said chamber and acts on said sleeve to disengage said torque transmitting members.

9. An in-hole motor as defined in claim 1; said clutch including a torque transmitting member fixed in said housing adjacent to said inlet in said shaft, a torque transmitting sleeve mounted on said shaft for mutual rotation and longitudinal movement to engage said torque transmitting member in said housing, said shaft and said sleeve having axially spaced different diameters forming a pressure chamber, and a port between said shaft opening and said chamber, whereby pressure of fluid ahead said shaft inlet exceeds the pressure of fluid in said chamber and acts on said sleeve to disengage said torque transmitting members, and a spring engaged between said shaft and said sleeve to engage said torque transmitting members when the pressure of fluid in said housing and in said shaft opening is substantially equal.

* * * * *